United States Patent [19]

Hooper, Jr.

[11] Patent Number: 4,920,717

[45] Date of Patent: May 1, 1990

[54] ORNAMENTAL HANDRAIL SYSTEM

[75] Inventor: William J. Hooper, Jr., Duluth, Ga.

[73] Assignee: Kawneer Company, Inc., Norcross, Ga.

[21] Appl. No.: 350,602

[22] Filed: May 11, 1989

[51] Int. Cl.[5] ..... E04H 17/14; E04B 1/62

[52] U.S. Cl. ..... 52/400; 256/24; 256/59

[58] Field of Search ..... 52/397, 400, 184, 126.4; 256/22, 24, 65, 67, 59

[56] References Cited

U.S. PATENT DOCUMENTS

| | | | |
|---|---|---|---|
| Re. 28,643 | 12/1975 | Blum . | |
| 2,610,369 | 9/1952 | Huizenga . | |
| 3,404,501 | 10/1968 | Von Wedel . | |
| 3,593,963 | 7/1971 | Horgan . | |
| 3,630,490 | 12/1971 | Horgan . | |
| 3,869,109 | 3/1975 | Russo . | |
| 3,955,799 | 5/1976 | Lauzier . | |
| 4,006,569 | 2/1977 | Kain | 52/400 |
| 4,054,268 | 10/1977 | Sher . | |
| 4,103,874 | 8/1978 | Horgan . | |
| 4,132,390 | 1/1979 | Pfarr . | |
| 4,155,540 | 5/1979 | Horgan . | |
| 4,390,165 | 6/1983 | Murdock . | |
| 4,397,124 | 8/1983 | Redman . | |
| 4,703,598 | 11/1987 | Wilson | 52/397 |

FOREIGN PATENT DOCUMENTS

| | | | |
|---|---|---|---|
| 2245830 | 4/1975 | France | 52/397 |

*Primary Examiner*—John E. Murtagh

*Attorney, Agent, or Firm*—Jones, Askew & Lunsford

[57] ABSTRACT

An ornamental handrail assembly is disclosed which provides an improved base assembly for mounting the glass panels such that the panels are easily leveled without removing the panels from the base assembly. The mounting arrangement necessitates fewer parts and requires less labor to set and adjust the panels. In another aspect, the ornamental handrail system includes a cap rail member which is secured to the upper edge of the glass panels quickly and easily and without the need for adhesives or separate fasteners.

16 Claims, 4 Drawing Sheets

ORNAMENTAL HANDRAIL SYSTEM

TECHNICAL FIELD

The present invention relates generally to a building construction for mounting panels, and relates more specifically to a glass handrail system for use alongside a stairway or other building surface wherein the handrail system comprises a plurality of aligned glass panels set in a base assembly and topped by a cap rail.

BACKGROUND OF THE INVENTION

Ornamental railing systems wherein the sole vertical supporting means comprises a plurality of aligned glass panels are widely used for mounting alongside a stairway or other building surface. The glass panels of such ornamental railing systems are typically set in a base assembly and topped by a cap rail. One example of such a glass handrail system is disclosed in U.S. Pat. Re. No. 28,643.

The tempered glass panels which are utilized in such ornamental handrail systems are adhered to a base runner by means of a structural adhesive, silicone, or grout. In this process, edge spacers, setting blocks, and glazing temporaries are necessary for proper setting and alignment of the glass panels. The amount of labor required to assemble these elements is substantial, and the number of components required to accomplish installation is considerable. A need therefore exists for a means of assembly which affords vertical adjustment of the glass panels while requiring less labor and inventory of parts.

Adjustment of the glass panels within the base assembly for aligning the vertical joints between adjacent panels is not easily accomplished in prior art ornamental handrail systems. To properly set and align a panel, the panel and edge spacer must be removed from the base assembly and the setting blocks shimmed. The panel is then reinstalled and alignment checked. If proper alignment is not achieved by the first shimming process, the panel must be removed again and the process repeated. A need therefore exists for a means of leveling the glass panels of an ornamental handrail system which does not necessitate removal of the glass panels from the base assembly.

The cap rail members set atop the glass panels of prior art ornamental handrail systems are typically fastened to the top of the panels with mechanical fasteners such as screws or the like or are adhered to the top of the panels with an epoxy adhesive. Mechanical fasteners suffer the disadvantage of requiring additional inventory of parts which are subject to misplacement and which are somewhat time-consuming to install. Epoxy adhesives tend to be messy and also require an undesirable amount of time to apply. Thus, there is a further need for a means of securing a cap rail member atop the glass panels of an ornamental handrail system which permits quick assembly and eliminates the need for adhesives or separate mechanical fasteners.

SUMMARY OF THE INVENTION

Stated generally, the present invention comprises an improved apparatus for mounting vertical glass panels for use in ornamental handrail systems and the like. The apparatus includes a base assembly for mounting the lower edge of the glass panels in such a manner that the panels are easily leveled. The base assembly eliminates the separate setting pad, edge cushion and spacer, and glazing temporary in favor of a single extruded retaining seat. The apparatus further includes a cap rail member which is secured to the upper edge of the glass panels without the need for adhesives or separate fasteners.

Stated somewhat more specifically, the present invention comprises an apparatus for supporting and leveling the lower edge of a vertical panel. The apparatus includes an elongated frame member having an upper surface and defining a longitudinal glazing recess in its upper surface. A retaining seat is disposed within the glazing recess and is configured to receive and support the lower edge of the panel. Leveling jacks operatively associated with the bottom wall of the glazing recess bear against the lower portion of the retaining seat, such that when the lower edge of the panel is supported within the retaining seat in the glazing recess, the leveling jacks are operable to level the panel. The retaining seat includes a locking means for fixing the upper portion of the retaining seat with respect to the walls of the glazing recess. In the disclosed embodiment, the locking means comprises a flange on the exterior of the retaining seat which engages a groove in the walls of the glazing recess. The retaining seat further includes a flexible bellows portion interconnecting the upper and lower portions of the retaining seat. As the leveling jacks are adjusted to level the panel, the bellows portion of the retaining seat flexes to accommodate elevational displacement of the lower retaining seat portion while the locking means maintains the upper retaining seat portion fixed with respect to the walls of the glazing recess. The disclosed embodiment of the apparatus further includes biasing members in the form of resilient flanges formed on the interior surface of the retaining seat for centering the panel within the glazing recess.

In another aspect of the present invention, an improved apparatus is disclosed for mounting a cap rail to the upper edge of a vertical panel. The cap rail mounting arrangement includes an inverted U-shaped rail retainer defining a glazing pocket therewithin. An elongated frame member having a glazing reglet formed in its lower surface is configured to be inserted over the rail retainer along a first direction of insertion. The pocket of the rail retainer is configured to receive the upper edge of the panel therewithin along a second direction of insertion. The rail retainer has a plurality of outer barbs formed on its exterior surface and angled in a direction generally coincident to the first direction of insertion. The rail retainer further includes a plurality of inner barbs formed on its interior surface within the pocket, the inner barbs being angled in a direction generally coincident with the second direction of insertion. An advantage of angling the barbs is that the outer barbs do not impede insertion of the cap rail down over the rail retainer; but, once the cap rail is mounted, the outer barbs grip the walls of the reglet to resist extraction of the cap rail from the rail retainer. Similarly, the inner barbs do not impede insertion of the panel into the pocket but, once the edge of the panel is inserted, the inner barbs grip the panel to resist extraction of the panel from the pocket.

Thus, it is an object of the present invention to provide an improved apparatus for mounting panels.

It is a further object of the present invention to provide an apparatus for mounting panels which permits easy leveling of the panels.

Another object of the present invention is to provide a means of leveling the glass panels of an ornamental handrail system which does not necessitate removal of the glass panels from the base assembly.

It is another object of the present invention to provide a means of assembly of an ornamental handrail system which affords vertical adjustment of the glass panels while requiring less labor and inventory of parts.

It is a further object of the present invention to provide an apparatus for mounting panels which accommodates leveling of the panels in an aesthetically improved manner.

It is yet another object of the present invention to provide a means of securing a cap rail member atop the glass panels of an ornamental handrail system which permits quick assembly and eliminates the need for adhesives or separate mechanical fasteners.

Other objects, features and advantages of the invention will become apparent upon reading the following specification, when taken in conjunction with the drawings and the appended claims.

DETAILED DESCRIPTION OF THE DISCLOSED EMBODIMENT

Figure 1:
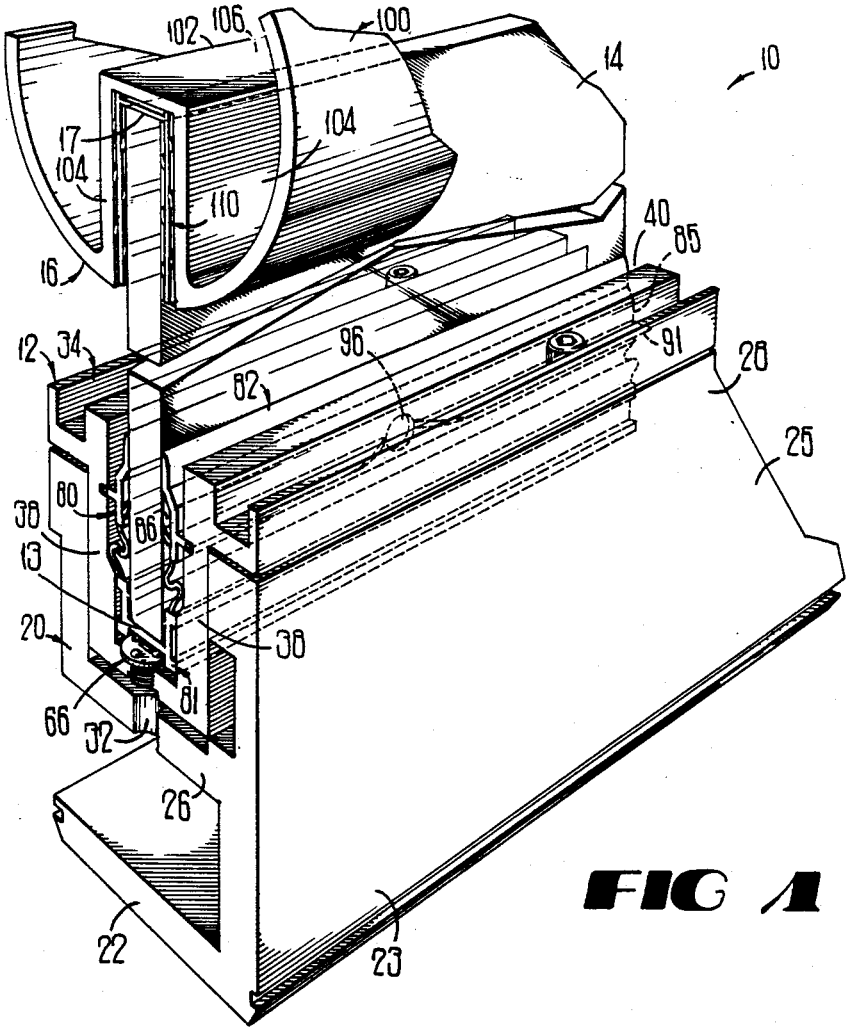
FIG. 1 is a perspective view of a preferred embodiment of an ornamental railing system according to the present invention.

Referring now to the drawings, in which like numerals indicate like elements throughout the several views, FIG. 1 discloses an ornamental railing system 10 comprising a base assembly 12 for receiving the lower edge 13 of a panel 14 and further comprising a cap rail assembly 16 mounted to the upper edge 17 of the panel. While the panel 14 of the disclosed embodiment is a tempered glass light, it will be understood that panels constructed of other materials may be employed as the aesthetics or physical demands of a particular installation may dictate.

Figure 2:
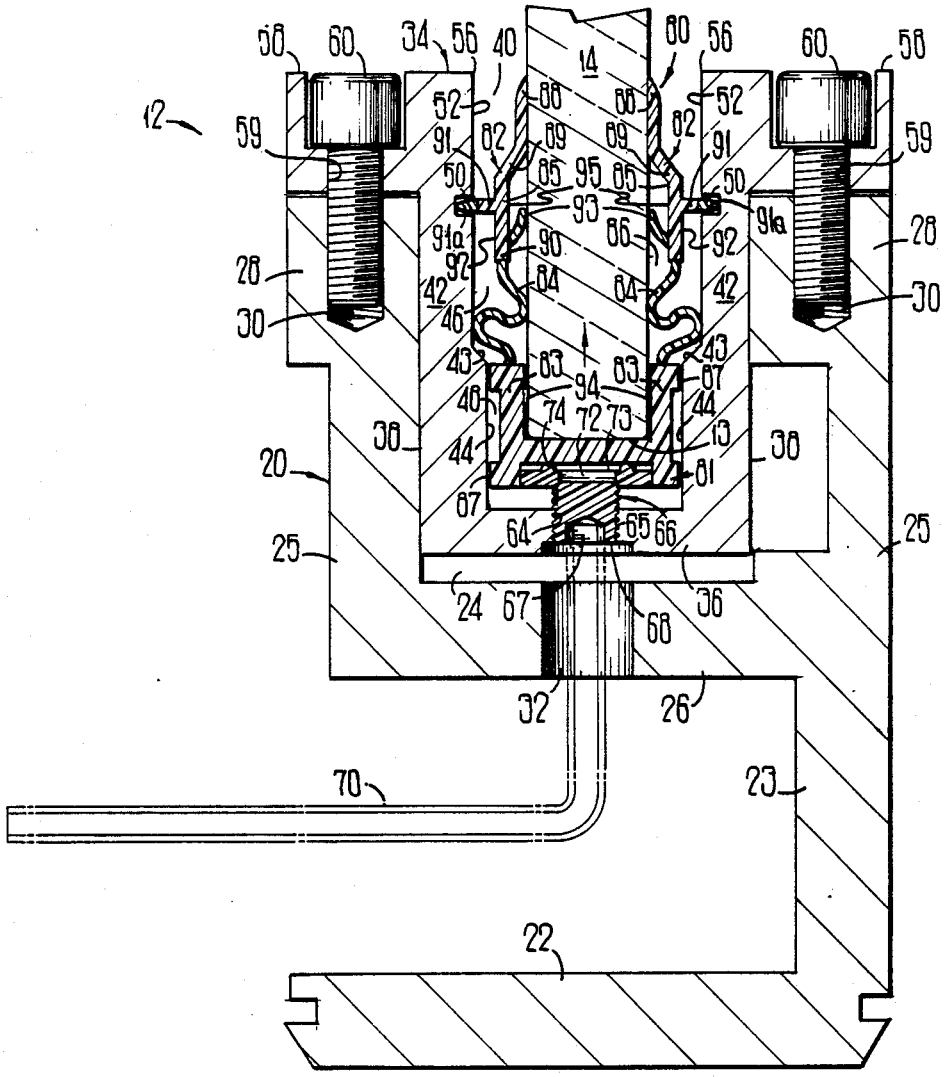
FIG. 2 is a transverse cross-sectional view of the base assembly of the ornamental railing system of FIG. 1.

Referring to FIGS. 1 and 2, the base assembly 12 includes a base member 20 comprising a Y-shaped rigid elongated extruded frame member having a base 22, an upwardly extending leg 23, and a trough 24 defined by opposing vertical walls 25 and a bottom wall 26. The vertical walls 25 have enlarged upper portions 28 having threaded vertical bores 30 formed therein. Smooth vertical bores 32 are formed in the bottom wall 26 in communication with the trough 24.

Disposed within the trough 24 is a liner channel 34 comprising a rigid elongated structural profile having a base 36, and opposing side walls 38 extending upwardly from the base. The side walls 38 and base 36 of the liner channel 34 define a glazing recess 40. The opposing side walls 38 comprise spaced apart upper side wall portions 42 tapering inwardly at opposing shoulder portions 43 to lower side wall portions 44 spaced somewhat more closely together than the upper side wall portions. The glazing recess 40 thus has an upper portion 46 and a reduced lower portion 48. Within the glazing recess 40, opposing grooves 50 are formed on mutually facing upper surfaces 52 of the upper side wall portions 42. Extending outwardly from the upper edges 56 of the side walls 38 of the glazing recess are opposing flanges 58, each of which has countersunk vertical bores 59 formed therethrough. Mounting bolts 60 are received through the bores 59 and into the threaded bores 30 in the enlarged upper portions 28 of the vertical walls 25 of the base member 20 to secure the liner channel 34 to the base member.

Figure 3:
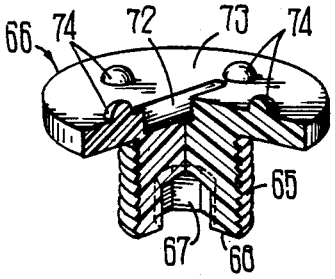
FIG. 3 is a partial cutaway view of a screw jack of the ornamental railing system of FIG. 1.

Threaded vertical bores 64 are formed in the base 36 of the liner channel 34 coaxially with the smooth bores 32 formed in the bottom wall 26 of the trough 24. The threaded bores 64 receive corresponding externally threaded lower bodies 65 of screw jacks 66 therewithin. The screw jacks 66, advantageously formed of nylon or the like, have hexagonal recesses 67 formed in their lower ends 68, which recesses are accessible through the bores 32 in the base member 20 by a conventional hex wrench 70. As can perhaps best be seen in FIG. 3, each screw jack 66 has a screw slot 72 formed in its upper end 73 for receiving the tip of a conventional flat-blade screwdriver. Also formed on the upper end 73 of each screw jack 66 are a plurality of projections 74.

Referring again to FIG. 2, disposed within the glazing recess 40 is a retaining seat 80. The retaining seat 80 has a rigid base 81 and opposing side walls 82 comprising lower vertical side wall portions 83 extending upwardly from the base 81, flexible bellows side wall portions 84 extending upwardly from the upper edges of the lower vertical wall portions 83, and upper wall portions 85 extending upwardly from the upper edges of the bellows portions 84. The base 81 and side walls 82 of the retaining seat define a glazing pocket 86. A plurality of lateral ridges 87 are formed on the exterior surfaces of the lower side wall portions 83. The upper wall portions 85 each include a reduced upper section 88 tapering outwardly at a shoulder 89 to an expanded lower section 90. The upper wall portions 85 have outwardly extending flanges 91 formed on their outer surfaces 92 which engage the grooves 50 on the side walls 38 of the glazing recess 40. The major portion of the flanges 91 is comprised of a rigid material, but the tips **91*a* of the flanges are flexible and resilient, to the advantage hereinbelow explained. The expanded lower sections 90 of the upper wall portions 85 further have flexible, resilient fingers 93 formed on their mutually facing inner surfaces 95. Similarly, the lower wall portions 83 have resilient fingers 94 formed on mutually facing portions. The resilient fingers 93, 94 engage the opposing surfaces of the panel 14 and bias the panel toward the center of the glazing pocket 86 and thus have the effect of centering the retaining seat 80 on the panel. To provide rigidity to the lower and upper wall portions 83, 85 and flexibility to the bellows portion 84, flexible flange tips 91*a*, and fingers 93, 94, the retaining seat 80** of the disclosed embodiment is coextruded from rigid and soft polyvinylidene chloride materials. However, it will be appreciated that the retaining seat may alternatively be formed from combinations of other rigid and flexible thermoplastic materials.

Referring again to FIG. 1, at regularly spaced intervals along the length of the retaining seat 80, the flanges 91 and the bellows portion 84 have interruptions 96 formed therethrough. As will be seen, when the retaining seat 80 is disposed within the glazing recess 40, the interruptions 96 permit a structural adhesive applied from the upper end of the glazing recess to penetrate into the lower portion 48 of the glazing recess to bond the panel 14 and retaining seat to the liner channel 34.

The lower portion of the glass panel 14 is received within the glazing pocket 86 of the retaining seat 80. The bottom edge 13 of the glass panel 14 rests on the base 81 of the retaining seat 80 and fits snugly between the lower wall portions 83. The reduced upper sections 88 of the upper wall portions 85 and the resilient fingers 93, 94 on the inner surfaces of the lower and upper wall portions 83, 85 grip the sides of the panel 14 and bias the panel toward the center of the glazing pocket 86.

Figure 4:
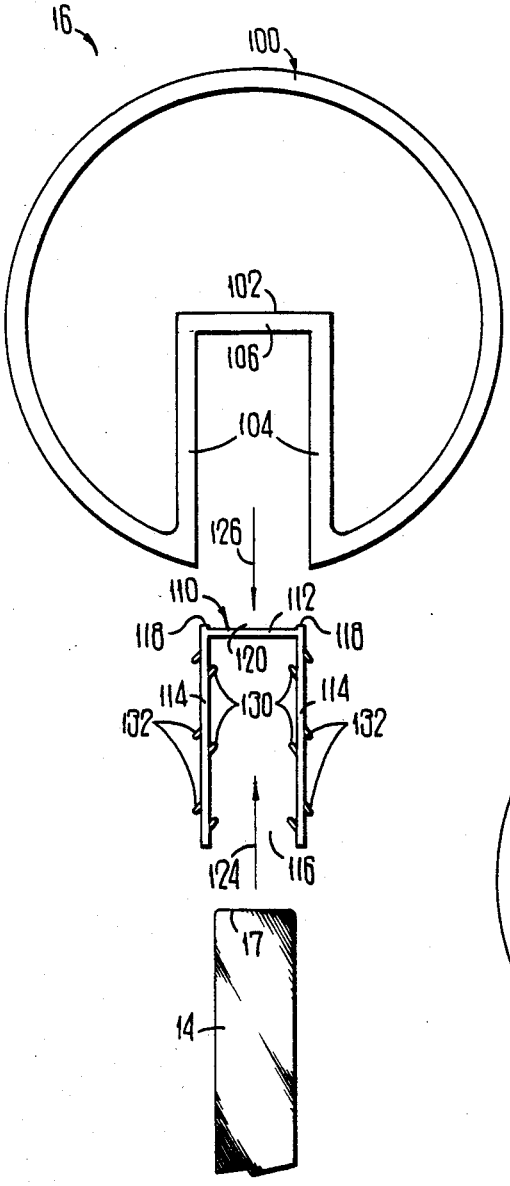
FIG. 4 is an exploded end view of the cap rail assembly of the ornamental railing system of FIG. 1.
Figure 5:
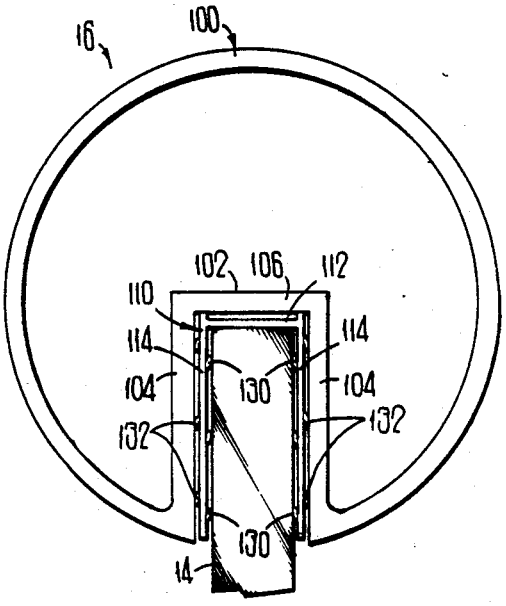
FIG. 5 is an end view of an assembled cap rail of the ornamental railing system of FIG. 1.

Referring now to FIGS. 4 and 5, the cap rail assembly 16 of the disclosed embodiment includes an elongated cap rail profile 100 having a downwardly facing glazing reglet 102 formed in its lower end. The reglet 102 is generally rectangular in cross-section and is defined by opposing side reglet walls 104 and an upper reglet wall 106.

Received within the glazing reglet 102 of the cap rail profile 100 is an elongated rail retainer 110. The rail retainer 110 is an inverted U-shaped elongate channel of resilient material such as extruded PVC. The rail retainer 110 comprises an upper rail retainer wall 112 and downwardly depending legs 114. A glazing pocket 116 is formed by the upper rail retainer wall 112 and the legs 114. The legs 114 include extensions 118 which project a short distance above the upper rail retainer wall 112 to form a shallow depression therebetween 120. As will be further described below, the depression 120 provides an adhesive reservoir along the upper side of the U-shaped rail retainer. The upper edge 17 of the panel 14 is inserted into the glazing pocket 116 of the rail retainer 110 in a direction indicated by the arrow 124. In turn, the cap rail profile 100 is inserted over the rail retainer 110 in a direction indicated by the arrow 126.

Figure 6:
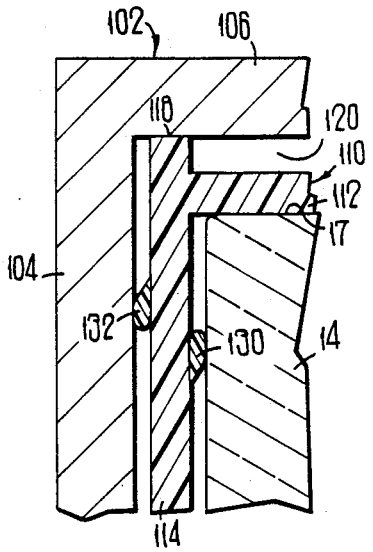
FIG. 6 is a transverse cross-sectional view of a portion of the assembled cap rail of FIG. 5.

On the inner surface of the legs 114 of the rail retainer 110 within the glazing pocket 116, a plurality of inner barbs 130 are formed. The inner barbs 130 are angled generally upwardly, that is, in the direction of insertion indicated by the arrow 124. The angled inner barbs 130 permit the rail retainer 110 to be easily assembled onto the upper edge 17 of the panel 14. However, once the rail retainer 110 is installed onto the upper edge 17 of the panel 14, the inner barbs 130 grip the opposing sides of the panel to resist extraction of the panel from the rail retainer. The gripping interaction between the inner barbs 130 and the panel 14 is perhaps best seen in the enlarged view of FIG. 6.

In a similar manner, a plurality of outer barbs 132 are formed on the exterior surface of the rail retainer 110. The outer barbs 132 are angled downwardly from the legs 114, that is, angled generally in the direction indicated by the arrow 126. The angled outer barbs 132 thus permit the cap rail profile 100 to be superimposed easily over the rail retainer 110. However, once the cap rail profile 100 is assembled onto the rail retainer 110, the outer barbs 132 grip the side reglet walls 104 to resist extraction of the rail retainer from the glazing reglet 102 of the cap rail profile 100. The gripping interaction between the outer barbs 132 and the side walls 104 of the glazing reglet 102 is again perhaps best seen in the enlarged view of FIG. 6.

Assembly of the ornamental railing system 10 will now be described. The base member 20 is first mounted to a floor (not shown) in a conventional manner, such as by bolting the base 22 of the base member to a mounting surface or by embedding the base into a concrete floor. With the base member 20 thus mounted, the liner channel 34 is inserted into the trough 24 in the base member. When the liner channel 34 is properly aligned with respect to the base member 20, the smooth bores 32 in the bottom wall 26 of the trough 24 of the base member are coaxially aligned with the threaded bores 64 in the base 36 of the liner channel 34. Similarly, the bores 59 in the flanges 58 of the liner channel 34 are coaxially aligned with the threaded bores 30 in the enlarged upper portions 28 of the base member 20. The liner channel 34 is fastened to the base member 20 by inserting the threaded shank of the mounting bolts 60 through the bores 59 in the liner channel and screwing them into the threaded bores 30 in the base member. The nylon screw jacks 66 are then installed into the liner channel 34, their threaded lower bodies 65 being inserted downwardly into the threaded bores 64 in the base 36 of the liner channel 34. The screw jacks 66 are advantageously screwed into their respective bores 64 by inserting the tip of a flat-blade screwdriver into the slot 72 in the head 73 of each screw jack.

The retaining seat 80 is then assembled onto the lower edge 13 of the glass panel 14. The lower portion of the panel 14 is inserted into the retaining seat 80 until the bottom edge 13 of the panel abuts the base 81 within the glazing pocket 86. With the glass panel 14 inserted into the glazing pocket 86, the resilient fingers 93, 94 on the lower and upper wall portions 83, 85 bear against the opposing lateral faces of the panel 14 and bias the panel toward the center of the glazing pocket, thereby centering the retaining seat 80 on the panel.

Figure 8:
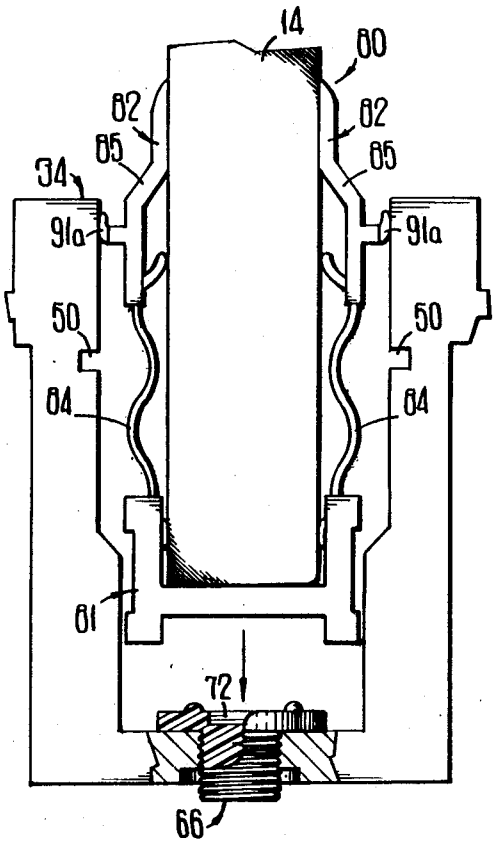
FIG. 8 is an end view of the base assembly of FIG. 2 depicting the installation of the liner channel into the base member.

Referring now to FIG. 8, the lower edge 13 of the panel 14 with retaining seat 80 assembled thereto is then inserted into the glazing recess 40. As the panel 14 is inserted into the glazing recess 40, the base 81 of the retaining seat 80 may engage one or the other of the tapered shoulder portions 43 of the side walls 38 of the glazing recess, thereby biasing the panel toward the center of the recess. As the panel 14 is inserted further, the resilient tips 91*a* of the flanges 91 flex as they impinge on the side walls 38 of the glazing recess 40, and the lateral ridges 87 on the lower vertical wall portions 83 of the retaining seat 80 engage the lower side wall portions 44 of the reduced lower section 48 of the glazing recess. Finally, the resilient tips 91*a* of the flanges 91 on the outer surfaces 92 of the upper wall portions 85 of the retaining seat 80 engage the grooves 50 formed on the upper walls 38 of the glazing recess, thereby locking the retaining seat within the glazing recess. With the glass panel 14 fully inserted into the glazing recess 40, the upper edge of the retaining seat 80 is substantially flush with the upper edge of the liner channel 34.

Figure 7:
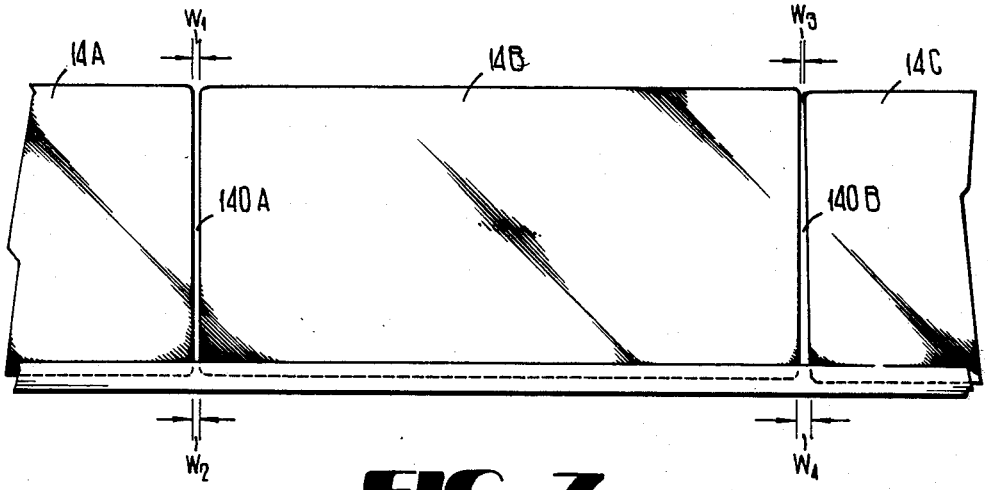
FIG. 7 is a side elevational view of the ornamental railing system of FIG. 1.

With the glass panel 14 thus installed into the base assembly 12, the panel may now be levelled. The necessity for leveling the panels is demonstrated by FIG. 7, wherein adjacent glass panels 14A, 14B, and 14C define vertical joints 140A, 140B therebetween. The panels 14A, 14B are properly leveled, and the vertical joint 140A therebetween has a constant width from top to bottom, that is, the width $W_1$ at the upper end of the joint 140A is equal to the width $W_2$ at the lower end of the joint 140A. In contrast, the left end of the panel 14C is set too low. As a result, the upper right corner of the panel 14B is not aligned with the upper left corner of the panel 14C, and the width $W_3$ at the upper end of the joint 140B is narrower than the width $W_4$ at the lower end of the joint 140A. To level the panel 14C and therby align the vertical joint 140B, it is necessary to raise the left end of the panel 14C in the manner now to be described.

Referring to FIG. 2, to level a panel 14, the tip of a conventional hex wrench 70 is inserted through the bore 32 in the bottom wall 26 of the trough 24. The tip of the hex wrench 70 fits into the hexagonal recess 67 in the lower end 68 of a screw jack 66, and the hex wrench is turned to raise or lower the screw jack as appropriate to level the panel 14.

Figure 10:
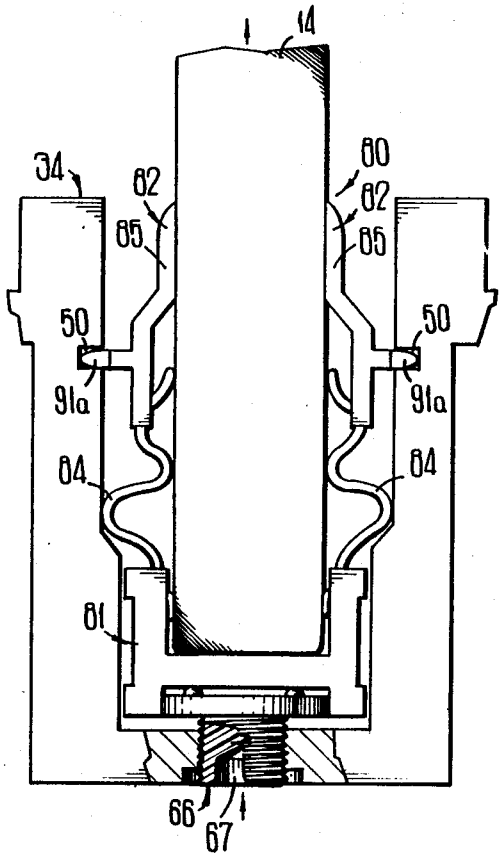
FIG. 10 is an end view of the base assembly of FIGS. 2 and 8 depicting the rail retainer in a raised position.
Figure 9:
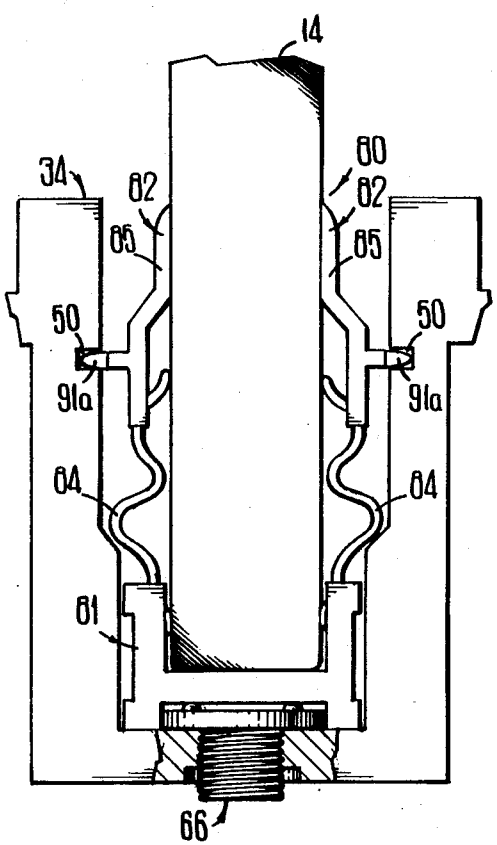
FIG. 9 is an end view of the base assembly of FIG. 2 depicting the rail retainer in a lowered position.

Referring now to FIGS. 9 and 10, as the screw jack 66 is raised in the manner just described, the protrusions 74 on the head 73 of the screw jack engage the lower surface of the base 81 of the retaining seat 80. As the screw jack 66 is further raised, the base 81 of the retaining seat 80, and thus the panel 14 whose lower edge 13 rests on the base, is raised to the desired elevation. An important feature of the base assembly 12 of the present invention is the cooperative interaction between the flanges 91 on the upper side walls 85 of the retaining seat 80 and the grooves 50 on the side walls 38 of the liner channel 34, which effectively anchors the upper wall portions 85 of the retaining seat with respect to the liner channel. As the screw jacks 66 are raised to level the panel 14, the base 81 and lower side wall portions 83 of the retaining seat 80 are raised. If the upper walls 85 of the retaining seat 80 were not anchored with respect to the liner channel 34, the upper edge of the retaining seat would tend to ride up over the top of the liner channel, thereby exposing the edge of the retaining seat to view from the side. However, in the disclosed embodiment the interlock between the flanges 91 on the upper side walls 85 of the retaining seat 80 and the grooves 50 on the mutually facing upper surfaces 52 of the upper side walls 42 of the liner channel prevent the upper edge of the retaining seat from being displaced upwardly as the glass panel 14 is jacked. The bellows portion 84 intermediate the lower and upper side walls 83, 85 of the retaining seat 80 flexes to accommodate upward travel of the base 81 and lower side walls 83 of the retaining seat as the glass panel 14 is jacked, without a corresponding upward displacement of the upper side walls 85.

After the glass panel 14 is leveled, a structural adhesive such as epoxy is applied at the upper edge of the base assembly 12 and into the glazing recess 40 between the retaining seat 80 and the liner channel 34. The interruptions 96 in the flanges 90 and bellows portion 84 at regularly spaced intervals permit flow of the adhesive around the glass panel 14 and into the lower portion 48 of the glazing recess 40, thereby providing maximum structural adhesive bonding between the glass panel and the liner channel 34.

The cap rail assembly 16 is now ready to be installed. Referring again to FIGS. 4–6, the rail retainer 110 is inserted down over the upper edge 17 of the glass panel 14. The inner barbs 130 are angled in the direction of insertion and thus permit the glass panel 14 to be inserted easily into the glazing pocket 116 of the rail retainer 110. However, once the rail retainer 110 is installed onto the panel 14, the angled inner barbs 130 grip the lateral surfaces of the panel and resist withdrawal of the panel from the rail retainer. Subsequently, the panel 14 with rail retainer 110 installed on its upper edge 17 is inserted into the glazing reglet 102 of the cap rail profile 100. The outer barbs 132 of the rail retainer 110 are angled in the direction of insertion and thus permit the cap rail profile 100 to be fitted easily down over the upper edge 17 of the panel 14. However, once the cap rail profile 100 is fitted onto the panel 14, the outer barbs 132 of the rail retainer 110 grip the side walls 104 of the glazing reglet 102 to resist disengagement of the cap rail profile from the upper edge 17 of the panel.

Optionally, prior to installing the cap rail profile 100 onto the rail retainer 110, a bead of adhesive may be applied into the adhesive reservoir 120 along the upper side of the rail retainer as an intermediate step to bond the cap rail profile to the rail retainer.

The construction of the rail retainer 110 of the disclosed cap rail assembly 16 permits the erection of the cap rail assembly to be accomplished in any order. In other words, the rail retainer 110 may first be fitted into the glazing reglet 102 of the cap rail profile 100, followed by insertion of the assembled rail retainer and cap rail profile onto the upper edge 17 of the panel 14. Since the order of assembly is of no particular consequence, only minimal training of the installer is required, and the possibility of damage to any of the components by misassembly is eliminated.

Further, the gripping action of the barbs 130, 132 of the rail retainer permits the cap rail assembly 16 to be erected without adhesives and without separate mechanical fasteners. Potentially messy adhesives are thus not required, and post-installation cleanup of the glass is thereby substantially reduced. Further, inventory of mechanical fasteners is eliminated. Finally, the simplified assembly procedure permits rapid erection of the cap rail assembly by relatively unskilled labor, thus reducing labor costs.

While the preferred embodiment is disclosed with respect to an ornamental railing system, it will be appreciated that the base assembly is easily adapted for levelably mounting other types of vertical panels. Similarly, the barbed rail retainer of the disclosed cap rail assembly is easily adapted for conjoining the edge of any panel to a cooperating structure, for example, for joining a top rail or header mullion onto a glass panel which is secured to a head member in a window opening.

Finally, it will be understood that the preferred embodiment has been disclosed by way of example, and that other modifications may occur to those skilled in the art without departing from the scope and spirit of the appended claims.

What is claimed is:

1. An apparatus for supporting and leveling a lower edge of a vertical panel, comprising:

an elongated frame member having an upper surface and defining a longitudinal glazing recess in said upper surface, said glazing recess including a bottom wall and opposing side walls;

a retaining seat disposed within said glazing recess, said retaining seat having an upper retaining seat portion, a lower retaining seat portion, and a flexible bellows portion interconnecting said upper and lower retaining seat portions;

locking means operatively associated with said side walls of said glazing recess and said upper retaining seat portion for fixing said upper retaining seat portion with respect to said side walls; and leveling jacks operatively associated with said bottom wall of said glazing recess for bearing against said lower portion of said retaining seat, whereby when the lower edge of the panel is supported within said retaining seat in said glazing recess, said leveling jacks are operable to effect elevational adjustment of the panel, said bellows portion of said retaining seat being flexible to accommodate elevational displacement of said lower retaining seat portion while said locking means maintains said upper retaining seat portion fixed with respect to said side walls of said glazing recess.

2. The apparatus of claim 1, further comprising means operatively associated with said retaining seat for biasing the panel toward the center of said glazing recess.

3. The apparatus of claim 1, wherein said locking means operatively associated with said side walls of said glazing recess and said upper retaining seat portion comprises:

flanges formed on one of said upper retaining seat portion and said side walls of said glazing recess; and cooperating grooves formed on the other of said upper retaining seat portion and said side walls of said glazing recess, said flanges engaging said grooves to fix said upper retaining seat portion with respect to said side walls of said glazing recess.

4. An apparatus for supporting and leveling a lower edge of a vertical panel, comprising:

an elongated frame member having an upper surface and defining a longitudinal glazing recess in said upper surface, said channel having interior and exterior surfaces and including a bottom glazing recess wall and opposing side glazing recess walls;

a retaining seat disposed within said channel, said retaining seat having an upper retaining seat portion, a lower retaining seat portion, and a flexible bellows portion connecting said upper and lower retaining seat portions;

flanges formed on the exterior surface of said upper retaining seat portion;

corresponding grooves formed on said side walls of said glazing recess, said flanges and said grooves cooperating to anchor said upper retaining seat portion with respect to said walls of said recess; and leveling jacks operatively associated with said bottom wall of said glazing recess for bearing against said lower portion of said retaining seat, whereby when a lower edge of a panel is supported within said retaining seat in said glazing recess, said leveling jacks are operable to effect elevational adjustment of said panel, said bellows portion of said retaining seat being flexible to accommodate elevational displacement of said lower retaining seat portion while said flanges engage said grooves to maintain said upper retaining seat portion fixed with respect to said side walls of said glazing recess.

5. The apparatus of claim 4, wherein said flanges formed on the exterior surface of said upper retaining seat portion have a plurality of apertures formed therethrough such that an adhesive applied between said side walls of said glazing recess and said retaining seat will flow through said apertures to structurally bond said lower edge of said glazing panel to the lower portion of said glazing recess.

6. The apparatus of claim 4, wherein said retaining seat extrusion further comprises biasing members operatively associated therewith for biasing the panel toward the center of said glazing recess.

7. The apparatus of claim 6, wherein said biasing members comprise resilient fingers formed on the interior surface of said retaining seat.

8. The apparatus of claim 4, wherein said upper retaining seat portion, said lower retaining seat portion, and said flanges formed on the exterior surface of said upper retaining seat portion are comprised of rigid thermoplastic material, and wherein said flexible bellows portion is comprised of flexible thermoplastic material, said rigid and flexible thermoplastic materials being coextruded.

9. An apparatus for mounting a frame member to an edge of a vertical panel, comprising:

walls defining a glazing reglet in said frame member;

a rail retainer shaped generally like an inverted "U" and defining a glazing pocket therewithin, said rail retainer having an interior surface and an exterior surface, said glazing reglet being configured to be inserted over said rail retainer along a first direction of insertion, and said glazing pocket of said rail retainer being configured to receive an edge of a panel therewithin along a second direction of insertion;

a plurality of outer barbs formed on said exterior surface of said rail retainer, said outer barbs being angled in a direction generally coincident to said first direction of insertion such that said barbs do not impede insertion of said elongated frame member onto said rail retainer but, once said frame member is inserted onto said rail retainer, grip said reglet walls to resist extraction of said frame member from said rail retainer;

a plurality of inner barbs formed on said interior surface of said rail retainer within said pocket, said inner barbs being angled in a direction generally coincident with said second direction of insertion such that said barbs do not impede insertion of said panel into said pocket but, once said panel edge is inserted, grip said panel to resist extraction of said panel from said pocket; and means defining a reservoir on an upper surface of said rail retainer prior to said rail retainer being inserted into said glazing reglet, whereby said reservoir may be filled with an adhesive prior to said rail retainer being inserted into said glazing reglet to secure said rail retainer within said glazing reglet.

10. The apparatus of claim 9, further comprising an adhesive filling said reservoir formed on said upper surface of said glazing reglet for securing said rail retainer within said glazing reglet.

11. An ornamental railing system comprising:

an elongated support frame member having an upper surface and means defining a longitudinal glazing channel in said upper surface, said means including a bottom channel wall and opposing side channel walls;

a retaining seat disposed within said glazing channel for receiving and supporting a lower edge of a panel therewithin, said retaining seat having an upper retaining seat portion, a lower retaining seat portion, and a flexible bellows portion interconnecting said upper and lower retaining seat portions;

locking means operatively associated with said side channel walls and said upper retaining seat portion for fixing said upper retaining seat portion with respect to said side channel walls;

leveling jacks operatively associated with said bottom channel wall for bearing against said lower portion of said retaining seat;

an elongated cap rail member having walls defining a glazing reglet in a lower surface thereof;

a rail retainer shaped generally like an inverted "U", said rail retainer defining a glazing pocket therewithin, said rail retainer having an interior surface and an exterior surface, said glazing reglet being configured to be inserted over said rail retainer along a first direction of insertion, and said pocket of said rail retainer being configured to receive an upper edge of the panel therewithin along a second direction of insertion;

a plurality of outer barbs formed on said exterior surface of said rail retainer, said outer barbs being angled in a direction generally coincident to said first direction of insertion such that said barbs do not impede insertion of said glazing reglet onto said rail retainer but, once said rail retainer is inserted, grip said reglet walls to resist extraction of said rail retainer from said reglet; and a plurality of inner barbs formed on said interior surface of said rail retainer within said pocket, said inner barbs being angled in a direction generally coincident with said second direction of insertion such that said barbs do not impede insertion of the upper edge of the panel into said pocket but, once said upper panel edge is inserted, grip said panel to resist extraction of said panel from said pocket, whereby when the lower edge of the panel is supported within said retaining seat in said channel, said leveling jacks are operable to effect elevational adjustment of the panel, said bellows portion of said retaining seat being flexible to accommodate elevational displacement of said lower retaining seat portion while said locking means maintains said upper retaining seat portion fixed with respect to said side channel walls; and whereby when said rail retainer is inserted within said reglet and the upper edge of the panel is received within said pocket of said rail retainer, said outer barbs grip said reglet walls to resist extraction of said rail retainer from said reglet, and said inner barbs grip said panel to resist extraction of said panel from said pocket to secure said panel to said cap rail member.

12. The apparatus of claim 11, further comprising means operatively associated with said retaining seat for biasing said panel toward the center of said channel.

13. The apparatus of claim 11, wherein said locking means operatively associated with said side channel walls and said upper retaining seat portion comprises:

flanges formed on one of said upper retaining seat portions and said side channel walls; and cooperating grooves formed on the other of said upper retaining seat portions and said side channel walls, said flanges engaging said grooves to fix said upper retaining seat portion with respect to said side channel walls.

14. An ornamental railing system comprising:

a panel having upper and lower edges and opposing first and second faces;

an elongated support frame member having an upper surface and means defining a longitudinal glazing channel in said upper surface, said glazing channel including a bottom channel wall and opposing side channel walls;

a retaining seat disposed within said glazing channel, said lower edge of said panel being received and supported therewithin, said retaining seat having an upper retaining seat portion, a lower retaining seat portion, and a flexible bellows portion interconnecting said upper and lower retaining seat portions;

locking means operatively associated with said side channel walls and said upper retaining seat portion for fixing said upper retaining seat portion with respect to said side channel walls;

leveling jacks operatively associated with said bottom channel wall for bearing against said lower portion of said retaining seat for leveling said panel;

an elongated cap rail member having walls defining a glazing reglet in a lower surface thereof;

a rail retainer shaped generally like an inverted "U" and defining a glazing pocket therewithin, said rail retainer having an interior surface and an exterior surface, said rail retainer being configured such that said cap rail member can be installed onto said rail retainer along a first direction of insertion with said rail retainer being received into said reglet, and said upper edge of said panel being received within said pocket of said rail retainer along a second direction of insertion;

a plurality of outer barbs formed on said exterior surface of said rail retainer, said outer barbs being angled in a direction generally coincident to said first direction of insertion such that said barbs do not impede insertion of said rail retainer into said reglet but, once said rail retainer is inserted, grip said reglet walls to resist extraction of said rail retainer from said reglet; and a plurality of inner barbs formed on said interior surface of said rail retainer within said pocket, said inner barbs being angled in a direction generally coincident to said second direction of insertion such that said barbs do not impede insertion of said upper edge of said panel into said pocket but, once said upper panel edge is inserted, grip said first and second faces of said panel to resist extraction of said panel from said pocket, whereby said lower edge of said panel is supported within said retaining seat in said channel, said leveling jacks being operable to effect elevational adjustment of said panel, said bellows portion of said retaining seat being flexible to accommodate elevational displacement of said lower retaining seat portion while said locking means maintains said upper retaining seat portion fixed with respect to said side channel walls; and whereby said rail retainer is inserted within said reglet and said upper edge of said panel is received within said pocket of said rail retainer, said outer barbs gripping said reglet walls to resist extraction of said rail retainer from said reglet, and said inner barbs gripping said panel to resist extraction of said panel from said pocket to secure said cap rail member to said panel.

15. The apparatus of claim 14, further comprising means operatively associated with said retaining seat for biasing said panel toward the center of said channel.

16. The apparatus of claim 14, wherein said locking means operatively associated with said side channel walls and said upper retaining seat portion comprises:

flanges formed on one of said upper retaining seat portions and said side channel walls; and cooperating grooves formed on the other of said upper retaining seat portions and said side channel walls, said flanges engaging said grooves to fix said upper retaining seat portion with respect to said side channel walls.

* * * * *